US011242703B2

(12) United States Patent
Sims et al.

(10) Patent No.: US 11,242,703 B2
(45) Date of Patent: Feb. 8, 2022

(54) LOW PROFILE ARC RESISTANT DOOR LATCHING MECHANISM

(71) Applicant: EATON CORPORATION, Cleveland, OH (US)

(72) Inventors: Daniel Garett Sims, Newberry, SC (US); Mark Christopher Gallman, Gaffney, SC (US); Robert Lawrence Mitchell, Jr., Greenwood, SC (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 1005 days.

(21) Appl. No.: 14/580,968

(22) Filed: Dec. 23, 2014

(65) Prior Publication Data

US 2016/0177603 A1 Jun. 23, 2016

(51) Int. Cl.
*E05C 9/06* (2006.01)
*E05C 9/18* (2006.01)

(52) U.S. Cl.
CPC ..... *E05C 9/063* (2013.01); *E05C 2009/1866* (2013.01)

(58) Field of Classification Search
CPC ..... Y10T 292/08; Y10T 292/0807; Y10T 292/0808; Y10T 292/0824; Y10T 292/0825; Y10T 292/0828; Y10T 292/0823; Y10T 292/0831; Y10T 292/0832; Y10T 292/0834; Y10T 292/0838; Y10T 292/0839; Y10T 292/0844; Y10T 292/0845; Y10T 292/0961; Y10T 292/0962; Y10T 292/0963; Y10T 292/0967; Y10T 292/0964; Y10T 292/0966; E05C 9/00; E05C 9/006; E05C 9/008; E05C 9/04; E05C 9/042; E05C 9/041; E05C 9/06; E05C 9/063; E05C 9/12; E05C 9/14; E05C 9/22; E05C 9/24; E05B 65/02; E05B 65/025; E05B 65/44; H02B 1/013; H02B 1/026; H02B 1/30; H02B 1/38; H02B 1/46; H02B 1/28; H02G 3/081; B65D 45/16; B65D 45/00; B65D 43/22; B65D 2251/1058; G06F 1/181
USPC ..... 312/215–218, 222, 223.1, 326, 296; 361/616, 622; 220/324, 318, 315
See application file for complete search history.

(56) References Cited

U.S. PATENT DOCUMENTS 1,775,092 A * 9/1930 French ..... E05B 65/025 292/159
3,175,873 A * 3/1965 Blomquist ..... E05C 9/14 220/324
3,403,432 A * 10/1968 Bencene ..... A61G 17/02 27/17
3,478,919 A * 11/1969 Turpen ..... B65D 88/126 220/1.5
3,845,976 A * 11/1974 Peterson ..... A61G 17/02 27/17
4,192,535 A * 3/1980 Picard ..... E05C 9/045 292/159

(Continued)

*Primary Examiner* — Alyson M Merlino
(74) *Attorney, Agent, or Firm* — Eckert Seamans Cherin & Mellott, LLC

(57) ABSTRACT

The disclosed concept pertains generally to electrical switching apparatus, such as circuit breakers, and more particularly, to enclosures for electrical switching apparatus and the components of the enclosures, such as latching doors and latching mechanisms.

5 Claims, 6 Drawing Sheets

(56) References Cited

U.S. PATENT DOCUMENTS

| | | | | |
|---|---|---|---|---|
| 5,201,557 | A * | 4/1993 | Schlack | E05C 9/026 292/161 |
| 5,503,440 | A * | 4/1996 | Peccoux | E05C 9/026 292/158 |
| 6,048,000 | A * | 4/2000 | Geringer | E05B 65/1053 292/166 |
| 6,071,052 | A * | 6/2000 | Kerr | F16B 39/34 411/247 |
| 8,733,853 | B2 * | 5/2014 | Gingrich | H02B 1/38 312/216 |
| 8,960,815 | B2 | 2/2015 | Karandikar et al. | |
| 2004/0194517 | A1 * | 10/2004 | Samsel | E05C 9/02 70/78 |
| 2014/0306465 | A1 * | 10/2014 | Kreitzer | E05B 15/0093 292/305 |

* cited by examiner

LOW PROFILE ARC RESISTANT DOOR LATCHING MECHANISM

BACKGROUND

Field

The disclosed concept relates generally to electrical switching apparatus and, more particularly, to electrical switching assemblies, such as for example, circuit breakers. The disclosed concept also relates to electrical switching enclosures and components associated therewith, such as, for example, latching doors and latching mechanisms.

Background Information

Electrical switching assemblies are generally well known in the art and include, for example, circuit switching devices and circuit interrupters, such as circuit breakers, contactors, motor starters, motor controllers and other load controllers. Circuit breakers are used for protecting electrical circuitry from damage due to an over current condition, such as an overload condition or a relatively high level short circuit or fault condition. Molded case circuit breakers, for example, include at least one pair of separable contacts which are operated either manually by way of a handle disposed on the outside of the case or automatically by way of an internal trip unit in response to an over current condition. In the automatic mode of operation, an electronic trip unit, for example, controls an operating mechanism that opens the separable contacts. In the manual mode of operation, the handle cooperates with the operating mechanism in order to open the separable contacts. Circuit breakers have at least one line terminal for connection to a power source and at least one load terminal for connection to a load, such as a motor. The separable contacts of the circuit breakers are internally connected to the line and load terminals.

Typically, electrical switching assemblies, e.g., circuit breakers, are contained within enclosures. The enclosures are effective to protect the electrical switching assemblies from exposure to environmental conditions. The enclosures typically include at least one circuit breaker and internal components positioned therein.

The design and structure of the enclosures can vary. In general, the enclosures are typically sized such that they are large enough to house the circuit breakers and related equipment and components. Enclosures known in the art include rectangular members having a base with sides which form a cavity wherein the circuit breakers and related equipment and components are positioned. It is understood that the shape of the enclosure is not critical and it is contemplated that various shapes are suitable. The enclosures also include a door connected to at least one of the sides of the enclosures. The door is structured to cover the open surface of the cavity, as well as to provide access to the cavity. For example, the door may connected to one side by hinges and may include a latch for opening and closing the door. It is typical for the door to be pulled open and therefore, open outwardly.

Further, existing arc-resistant latching mechanism designs can be bulky and require a relatively large amount of space to secure all associated components while maintaining the ability to install and remove withdrawable electrical devices, e.g., circuit breakers, fuses, and transformers, without interference with latching components.

Due to space limitation being a prevalent constraint associated with switchgear applications, there is an increasing need to design and develop switchgear assemblies that are compact and continue to meet all existing functionality requirements.

Accordingly, there is room for improvement in known electrical switching assembly, such as circuit breaker, enclosures. It is desired that an enclosure, access door and arc resistant latching mechanism be designed and developed to enclose or house the circuit breaker and associated components, to be capable of easy access in small spaces, of withstanding internal pressure waves and other destructive forces that can be produced under fault conditions, and of being cost effective to construct and install.

SUMMARY

These needs and others are met by embodiments of the disclosed concept.

In one aspect, the disclosed concept provides a latching apparatus for an enclosure of an electrical switching assembly. The enclosure includes a housing having an outer surface structured to form a cavity therein and, an access panel connected to the housing and structured to open to provide access to the cavity of the housing. The latching apparatus includes a series of stationary c-shaped channels mounted to and extending along at least a portion of a perimeter of the housing, each of the series of stationary c-shaped channels has a series of stationary pins inserted and extending through both legs of the c-shaped channel; a movable latch rod connected to and extending along at least a portion of a perimeter of the access panel, the latch rod structured to be positioned within the stationary c-shaped channel when the access panel is in its closed position in relation to the housing, and the latch rod having formed therein a series of hook-shaped profiles structured to mechanically engage the stationary pins; and a handle connected to the access panel and structured to mechanically engage the latch rod and translate the latch rod a distance along the perimeter of the access panel such that the hook-shaped profiles mechanically engage the stationary pins and latch the access panel with the housing.

The electrical switching assembly can be a circuit breaker.

The handle can include a rack-and-pinion mechanism.

The stationary pins can be selected from clevis-style pins, bolts and other similar components.

In certain embodiments, the series of stationary c-shaped channels is mounted to the housing using a series of a combination of nut and bolt, e.g., countersunk bolt. The channel can be formed of steel or other comparable material.

In certain embodiments, the latch rod is mounted to the access panel by forming a tab along at least a portion of the perimeter of an interior face of the access panel and attaching the latch rod to the tab using a series of a combination of nut and screw. The nut can be a lock nut, e.g., nylon lock nut, and the screw can be a machine screw.

In another aspect, the disclosed concept provides an enclosure for an electrical switching assembly. The enclosure includes a housing having an outer surface structured to form a cavity therein; an access panel connected to the housing and structured to open to provide access to the cavity of the housing; and a latching apparatus. The latching apparatus includes a series of stationary c-shaped channels mounted to and extending along at least a portion of a perimeter of the housing, the channel having a series of stationary pins inserted and extending through both legs of the c-shaped channel; a movable latch rod connected to and extending along at least a portion of a perimeter of the access panel, the latch rod structured to be positioned within the stationary c-shaped channel when the access panel is in its closed position in relation to the housing, and the latch rod having formed therein a series of hook-shaped profiles structured to mechanically engage the stationary pins; and a handle connected to the access panel and structured to mechanically engage the latch rod and translate the latch rod a distance along the perimeter of the access panel such that the hook-shaped profiles mechanically engage the stationary pins and latch the access panel with the housing.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
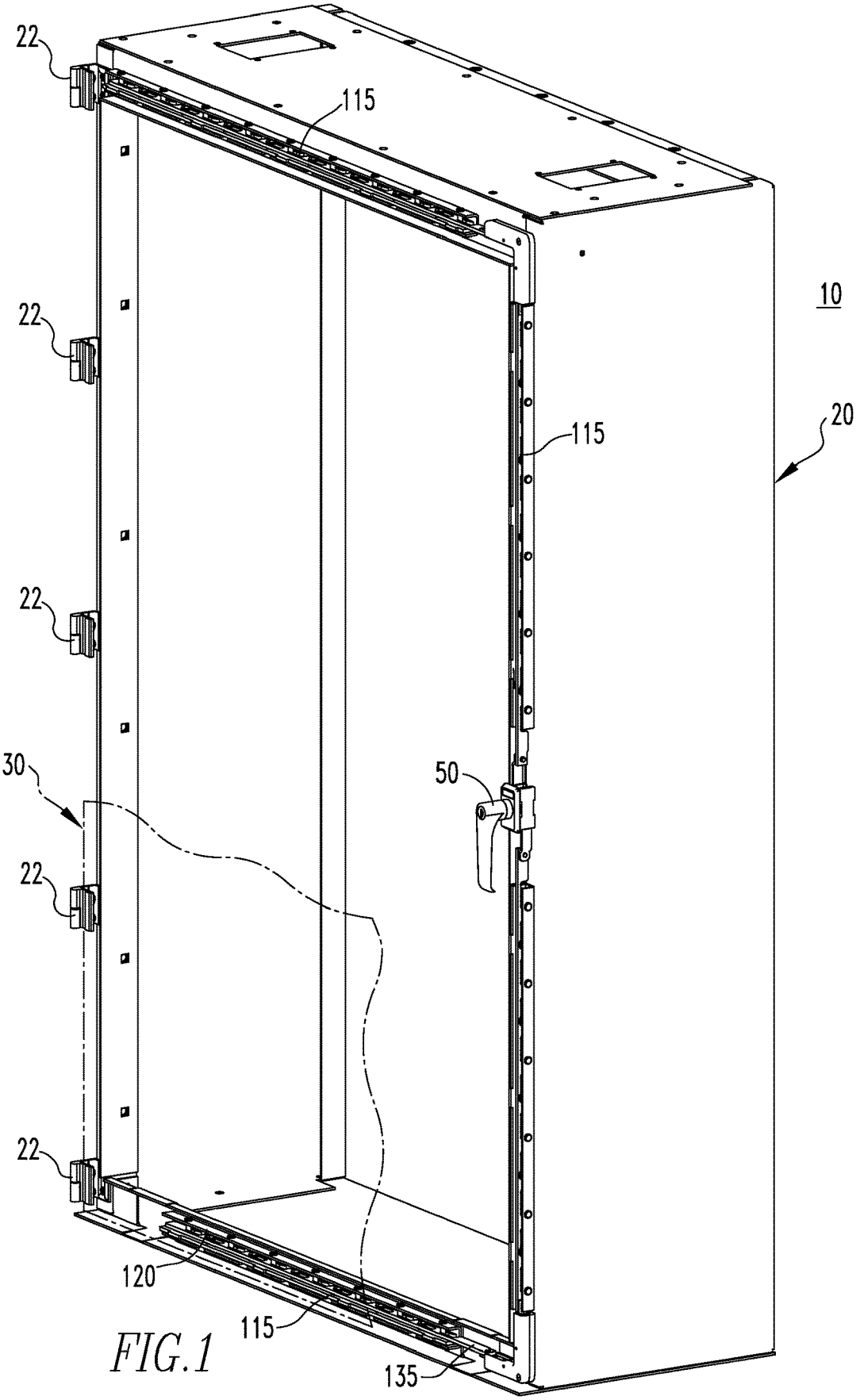
FIG. 1 is a schematic of an enclosure having a latching mechanism mounted thereto, in accordance with certain embodiments of the disclosed concept.

Direction phrases used herein, such as, for example and without limitation, top, bottom, left, right, upper, lower, front, back and derivatives thereof, relate to the orientation of the elements shown in the drawings and are not limiting upon the claims unless expressly recited therein.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The disclosed concept is described in association with electrical switching apparatus or assemblies, such as circuit breakers, although it will become apparent that the disclosed concept could also be applied to other types of electrical switching apparatus, e.g., without limitation, other circuit switching devices and other circuit interrupters such as contactors, motor starters, motor controllers and other load controllers.

The arc resistant latching door mechanism, which is described in accordance with the disclosed concept, is effective to provide mechanical strength needed to secure an external door of a switchgear enclosure when subjected to internal pressure waves and similar destructive forces that may be produced under fault conditions. The arc resistant latching door mechanism includes a latch rod, which is described in detail later herein, that provides proper compression and seal of a gasket material, which may be used in conjunction with the latching mechanism. Additionally, the arc resistant latching mechanism requires less space for installation than conventional latching mechanisms that are known in the art.

FIG. 1 shows an enclosure 10 that includes a housing 20 and an access panel 30 that provides access to the interior of the housing 20. The access panel 30 is attached to the housing 20 by frame components 22, which are positioned on the perimeter of one side of the housing. The frame components 22 allow the access panel 30 to be opened and closed. The frame components 22 can be selected from a wide variety of fasteners that are known in the art and commercially available. Typically, the frame components 22 are selected from a variety of known, commercially available, hinged-type fasteners that allow the access panel 30 to be pulled outward in order to access the interior of the housing 20. As shown in FIG. 1, along the perimeter on the three sides of the housing 20 and the access panel 30 (which do not include the frame components 22) is mounted a latching mechanism 115. Although, FIG. 1 shows the latching mechanism 115 mounted on three sides, it is contemplated that the latching mechanism 115 may be mounted along the perimeter on all four sides of the housing 20 and the access panel 30 (including the side having the frame components 22). The latching mechanism 115 can be mounted directly to the housing 20 and the access panel 30 or, alternatively, a plate can be mounted to or fabricated along the perimeter of the housing 20 and the access panel 30, and the latching mechanism 115 can be attached to the plate. As shown in FIG. 1, the access panel 30 also includes a handle 50 mounted thereto. The handle 50 can be selected from various handles that are known in the art for this purpose and commercially available. Typically, the handle 50 is a rack-and-pinion-style handle, which can be turned in a clockwise or counterclockwise direction to open and close the access panel 30. In addition, the handle 50 is operable upon turning to actuate or de-actuate the latching mechanism 115. Although FIG. 1 shows the handle 50, it is contemplated that various mechanisms can be employed to open and close the access panel 30, and to actuate or de-actuate the latching mechanism 115.

The latching mechanism 115 includes a series of stationary c-shaped formed channels 120 mounted to the perimeter of the housing 20 and a movable latch rod 135 connected to the perimeter of the access panel 30. The stationary channels 120 can be formed from various materials known in the art including, but not limited to, steel. As shown in FIG. 1, the stationary channels 120 are mounted to the perimeter of three sides of the housing 20 and the latch rod 135 is connected to the perimeter of three sides of the access panel 30. As previously described, the stationary channel 120 and the movable latch rod 135 can be directly mounted/connected to the housing 20 and access panel 30, respectively. Alternatively, the channel 120 and the latch rod 135 can each be directly mounted/connected to a plate or tab, which can be formed along the perimeter of each of the housing 20 and the access panel 30, respectively. Various mechanisms can be used to mount the channel 120 and the latch rod 135. Suitable mechanisms include those known in the art for fastening one substrate to another substrate, such as, nut/bolt or nut/screw combinations (not shown).

Figure 2:
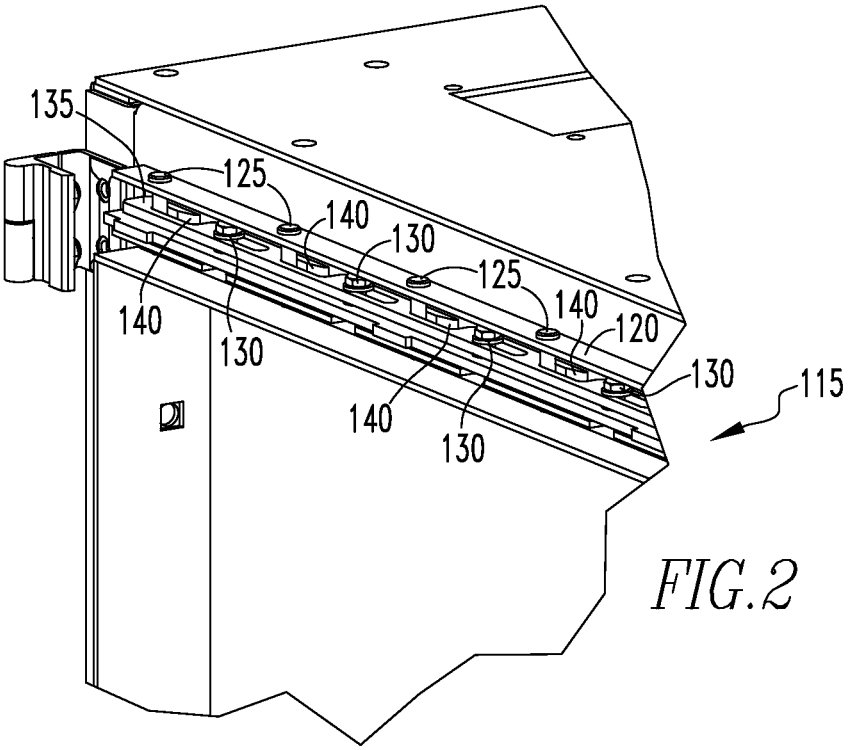
FIG. 2 is a detail view of the latching mechanism shown in FIG. 1, in accordance with certain embodiments of the disclosed concept.

In certain embodiments, the series of channels 120 is mounted to the face of the housing 20 using nut/countersunk bolt combinations 155 (shown in FIG. 9) and the latch rod 135 is mounted to a plate or tab, which is attached, e.g., welded, to an interior face of the access panel 30, using lock nut/screw, e.g., nylon lock nut/machine screw, combinations 130 (shown in FIG. 2). It is contemplated that a friction reducing material, such as, but not limited to, nylon washers, also can be positioned between the latch rod 135 and the plate or tab to reduce friction and promote a smoother action for movement of the latch rod 135.

FIG. 2 shows the details of view A of the latching mechanism 115 as shown in FIG. 1 including the series of c-shaped channels 120 and latch rod 135. Each of the c-shaped channels 120 has stationary pins 125 inserted through both legs. The stationary pins 125 can include clevis-style pins, bolts or other similar components, which are known in the art. The latch rod 135 is mounted to the perimeter of the access panel 30 using a series of nut/screw combinations 130. It is contemplated that the latch rod 135 can be mounted to the access panel 30 using various configurations. In certain embodiments, the latch rod 135 is guided by a full-length tab (not shown) which is attached, e.g., welded, to an interior face of the access panel 30. The latch rod 135 can be secured to this tab by screws, e.g., machine screws, (not shown) and lock nuts, e.g., nylon lock nuts, (not shown). As previously described, a friction reducing material can also be positioned between the latch rod 135 and guide tab (not shown) to reduce friction and promote a smoother action. The latch rod 135 has formed therein a series of hook-shaped profiles 140. The stationary pins 125 extend through the hook-shaped profiles 140 in the latch rod 135 to form latching catch points. When the access panel 30 is closed, the latch rod 135 is positioned within the series of c-shaped channels 120.

Figure 3:
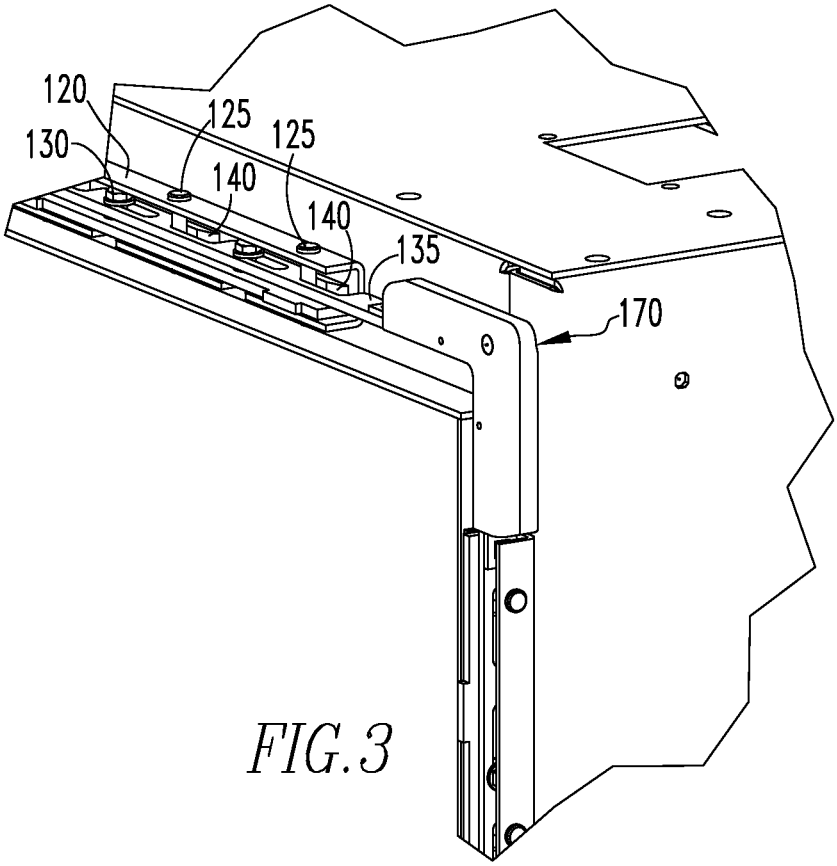
FIG. 3 is a detail view of a corner mechanism shown in FIG. 1, in accordance with certain embodiments of the disclosed concept.

FIG. 3 shows the details of view B of the latching mechanism 115 as shown in FIG. 1. FIG. 3 shows the series of c-shaped channel 120*s*, pins 125, nut/screw combinations 130, latch rod 135 and hook-shaped profiles as shown in FIG. 2. In addition, FIG. 3 shows a corner mechanism 170 mounted on a corner portion of the access panel 30. The corner mechanism 170 can be a bracket or the like, which is known in the art and commercially available. The corner mechanism 170 is structured to allow the latch rod 135 to translate motion through 90 degrees. The channel 120 does not extend around the perimeter of the corners of the housing 20.

When the access panel 30 is closed, the latch rod 135 is positioned within the channel 120 and the handle 50 on the access panel 30 is turned in a particular direction, e.g., clockwise or counterclockwise, to actuate the latching mechanism 115. Upon actuation, the latch rod 135 translates a distance around the perimeter of the access panel 30 and housing 20 causing the stationary pins 125 and the hook-shaped profiles 140 to be mechanically engaged. As previously described, the stationary pins 125 extend through the hook-shaped profiles 140 in the latch rod 135 to form latching catch points and to securely latch the access panel 30 to the housing 20. To de-actuate the latching mechanism 115 and open the access panel 30, the handle 50 is turned in the opposite direction and causes the latch rod 135 to translate in an opposite direction. As a result, the hook-shaped profiles 140 disengage the stationary pins 125 and allow the access panel 30 to be opened.

Figure 4:
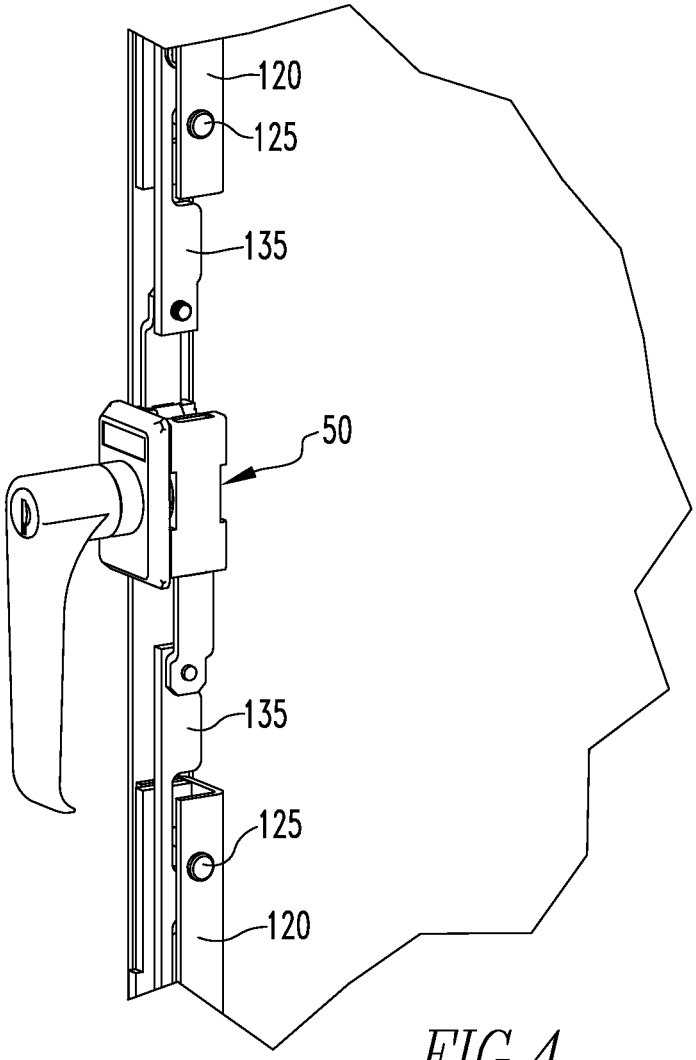
FIG. 4 is a detail view of a latch handle shown in FIG. 1, in accordance with certain embodiments of the disclosed concept.

FIG. 4 shows the details of view C of the latching mechanism 115 as shown in FIG. 1. FIG. 4 shows the door handle 50, series of c-shaped channels 120, stationary pins 125 and latch rod 135. As shown, the series of c-shaped channels 120 is stationary and mounted to the perimeter of the housing 20, and the latch rod 135 is mechanically engaged with the door handle 50 and the latch rod 135 is structured to translate in a direction along the perimeter of the access panel 30/housing 20 upon turning of the handle 50.

Figure 5:
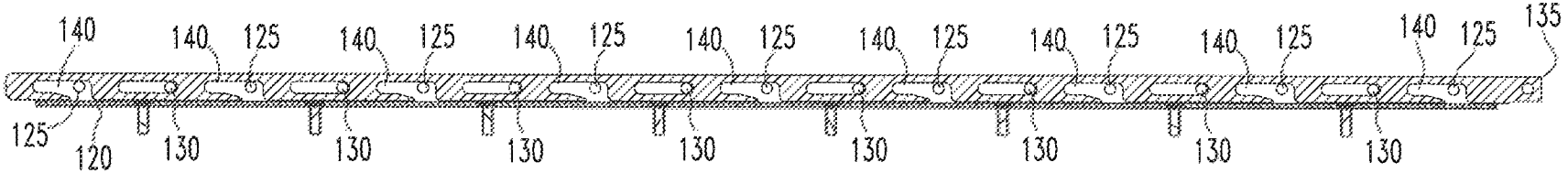
FIG. 5 is a side view schematic of the latching mechanism when in an open or de-actuated position, in accordance with certain embodiments of the disclosed concept.

FIG. 5 is a schematic showing the latching mechanism 115 including the channel 120, stationary pins 125, latch rod 135, nut/screw combinations 130 and hook-shaped profiles 140. In particular, FIG. 5 shows the latching mechanism 115 in its open or de-actuated condition.

Figure 6:
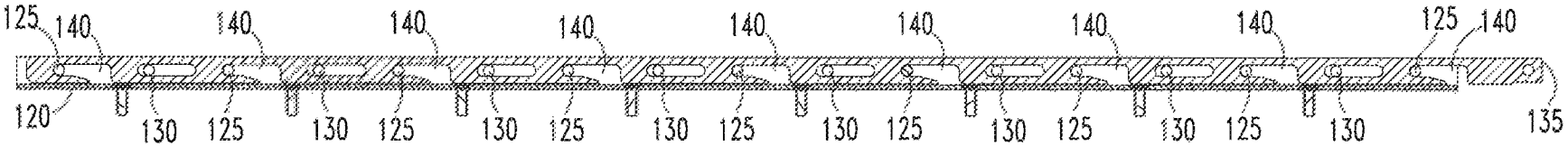
FIG. 6 is a side view schematic of the latching mechanism when in a closed or actuated position, in accordance with certain embodiments of the disclosed concept.

FIG. 6 is a schematic showing the latching mechanism 115 including the series of c-shaped channels 120, stationary pins 125, latch rod 135, nut/screw combinations 130 and hook-shaped profiles 140. In particular, FIG. 6 shows the latching mechanism 115 in its closed or actuated condition. As the latch rod 135 translates from the open position shown in FIG. 5 to the closed position shown in FIG. 6, the hook-shaped profiles 140 are moved to mechanically engage the stationary pins 125 and to latch or lock the access panel 30 with the housing 20 (as shown in FIG. 1).

Figure 7:
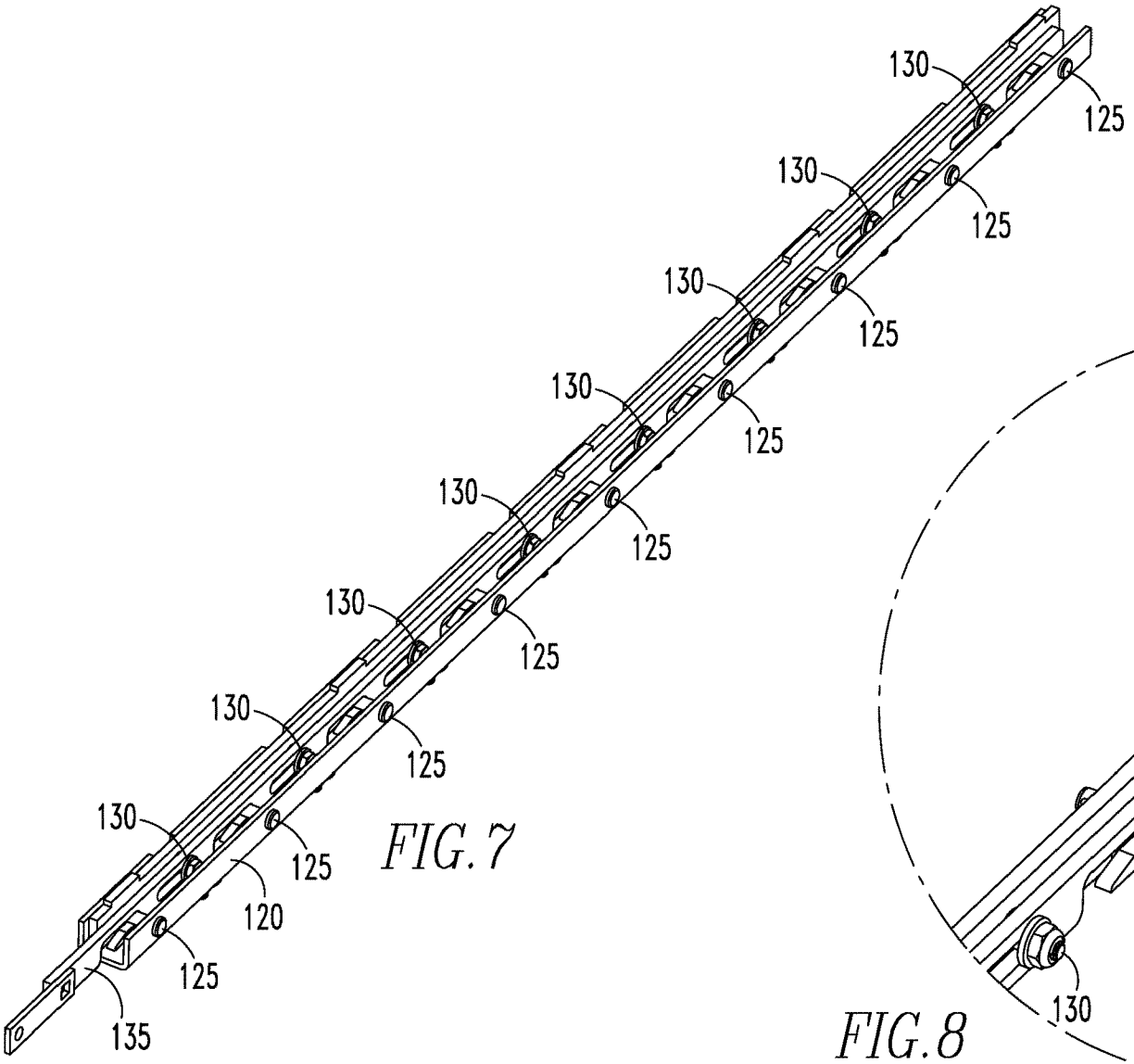
FIG. 7 is a schematic showing a movable latch rod positioned within a stationary channel, in accordance with certain embodiments of the disclosed concept.

FIG. 7 is a schematic showing an isometric view of the latching mechanism 115 including the series of c-shaped channels 120, stationary pins 125, latch rod 135 and nut/screw combinations 130.

Figure 8:
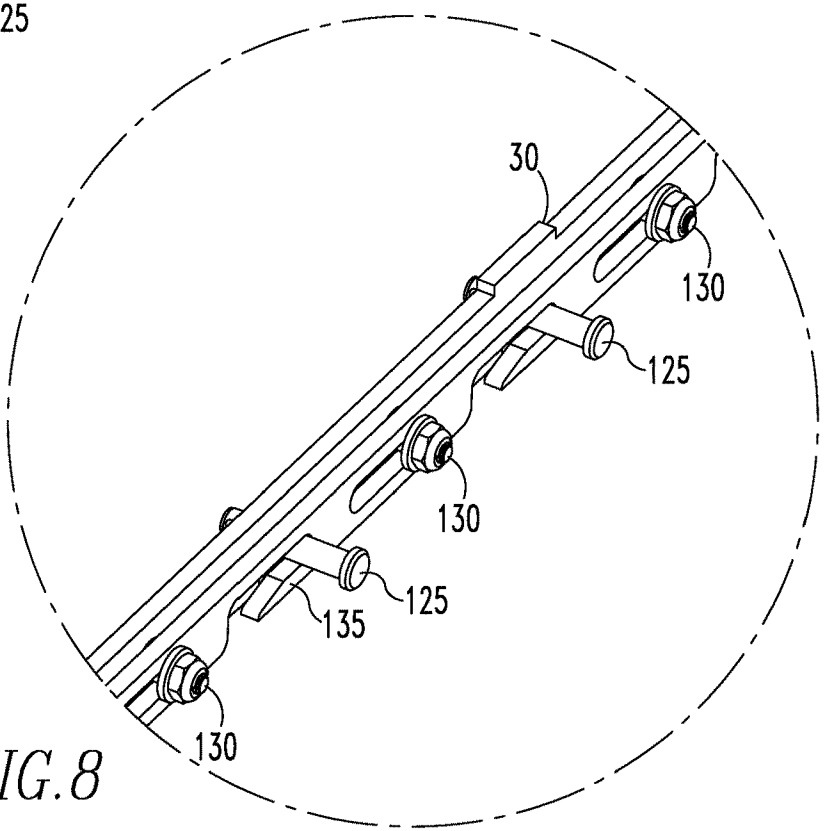
FIG. 8 is a detail view of the movable latch rod shown in FIG. 7 in the absence of the stationary channel, in accordance with certain embodiments of the disclosed concept.

FIG. 8 is a schematic of the latching mechanism 115 in the absence of the series of c-shaped channels 120. In FIG. 8, the latch rod 135 is attached to the access panel 30 using the nut/screw combinations 130. In addition, FIG. 8 shows the stationary pins 125 that extend through the hook-shaped profiles 140. The stationary pins 125 are mechanically engaged within the hook-shaped profiles 140 (to latch or secure the access panel 30 to the housing 20 as shown in FIG. 1).

Figure 9:
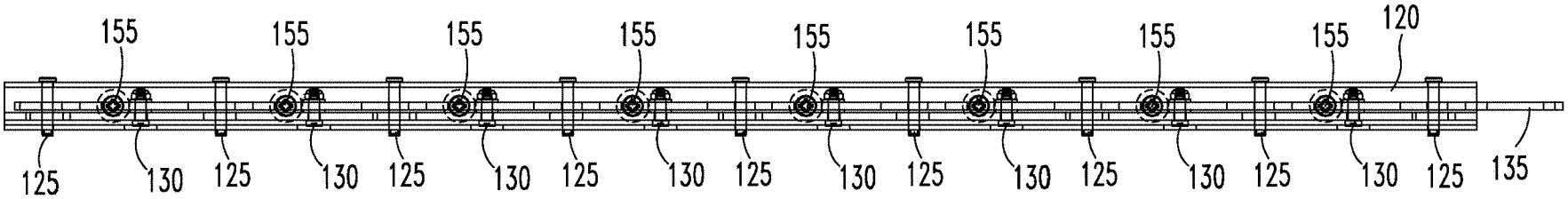
FIG. 9 is a front view schematic showing the latching mechanism, in accordance with certain embodiments of the invention.

FIG. 9 is a front view schematic of the latching mechanism 115 showing the series of c-shaped channels 120, stationary pins 125, nut/screw combinations 130 and latch rod 135. In addition, FIG. 9 shows the nuts/countersunk bolts 155, which attach the series of c-shaped channels 120 to the housing 20.

It is understood that the number of stationary pins 125, nut/screw combinations, nut/bolt combinations and hook-shaped profiles can vary depending on, for example, the particular electrical switching assembly and enclosure. Further, it is contemplated that the enclosure may include a gasket used in combination with the latching mechanism 115. The gasket is typically positioned between the access panel 30 and the housing 20. The latch rod 135 may be mounted to the access panel 30 such that the nut/screw combinations 130 used to connect the latch rod 135 can also serve to compress and seal the gasket.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof

What is claimed is:

1. An arc-resistant circuit breaker enclosure, the enclosure comprising:

a housing having an outer surface and a perimeter, the housing further comprising:

a bottom wall;

a top wall;
a first side wall;
a second side wall;
a back wall; and
a cavity formed by the bottom wall, top wall, first side wall, second side wall, and back wall;
a front access panel, having a perimeter, connected to the first side wall along a portion of the perimeter of the housing, and the front access panel is structured to open outwardly to provide access to the cavity of the housing; and
an arc resistant latching apparatus, comprising:
a series of stationary substantially c-shaped channels mounted to the bottom wall, top wall, and the second side wall, and extending in succession along portions of the perimeter of the housing, each stationary substantially c-shaped channel having a length, an upper leg, a lower leg, and a vertical wall extending the length of the stationary substantially c-shaped channel, connecting the upper and lower legs;
a series of stationary pins inserted and extending through the upper leg and the lower leg of each of the stationary substantially c-shaped channels,
wherein the stationary pins are inserted such that the stationary pins are parallel to the vertical wall and parallel to a face plane of the front access panel;
a plurality of movable latch rods connected to and extending along portions of the perimeter of the front access panel, the plurality of movable latch rods are structured to be positioned within the series of stationary substantially c-shaped channels, and each of the plurality of movable latch rods, having formed therein, a series of hook-shaped profiles in succession and structured to correspondingly mechanically engage the stationary pins; and
a handle connected to the front access panel and structured to place the front access panel in a closed position and correspondingly actuate the latching apparatus by translating the plurality of movable latch rods in a first direction in succession along the perimeter of the front access panel within the series of stationary substantially c-shaped channels, a distance that extends along the length of each of the stationary substantially c-shaped channels in the series, such that the series of hook-shaped profiles mechanically engage the series of stationary pins to latch the front access panel to the housing when the front access panel is in the closed position, and structured to open the front access panel correspondingly de-actuating the latching apparatus by translating the plurality of movable latch rods in a second direction opposite the first direction, such that the series of hook-shaped profiles mechanically disengage from the series of stationary pins,
wherein a circuit breaker is housed in the enclosure and the latching apparatus latches the front access panel to the housing when the front access panel is in the closed position and is subjected to internal pressure waves and destructive forces produced under fault conditions.

2. The circuit breaker enclosure of claim 1, wherein the series of stationary substantially c-shaped channels are mounted to the housing using a series of a combination of nuts and countersunk bolts.

3. The circuit breaker enclosure of claim 1, wherein the series of stationary substantially c-shaped channels are formed of steel.

4. A circuit breaker enclosure, comprising:
a housing having an outer surface and a perimeter, the housing further comprising:
a bottom wall;
a top wall;
a first side wall;
a second side wall;
a back wall; and
a cavity formed by the bottom wall, top wall, first side wall, second side wall, and back wall;
a front access panel, having a perimeter, connected to the first side wall along a portion of the perimeter of the housing, and the front access panel is structured to open outwardly to provide access to the cavity of the housing; and
an arc resistant latching apparatus, comprising:
a series of stationary substantially c-shaped channels mounted to the bottom wall, top wall, and the second side wall, and extending in succession along portions of the perimeter of the housing, each stationary substantially c-shaped channel having a length, an upper leg, a lower leg, and a vertical wall extending the length of the stationary substantially c-shaped channel, connecting the upper and lower legs;
a series of stationary pins inserted and extending through the upper leg and the lower leg of each of the stationary substantially c-shaped channels,
wherein the stationary pins are inserted such that the stationary pins are parallel to the vertical wall and parallel to a face plane of the front access panel;
a plurality of movable latch rods connected to and extending along portions of the perimeter of the front access panel, the plurality of movable latch rods are structured to be positioned within the series of stationary substantially c-shaped channels, and each of the plurality of movable latch rods, having formed therein, a series of hook-shaped profiles in succession and structured to correspondingly mechanically engage the stationary pins; and
a handle connected to the front access panel and structured to place the front access panel in a closed position and correspondingly actuate the latching apparatus by translating the plurality of movable latch rods in a first direction in succession along the perimeter of the front access panel within the series of stationary substantially c-shaped channels, a distance that extends along the length of each of the stationary substantially c-shaped channels in the series, such that the series of hook-shaped profiles mechanically engage the series of stationary pins to latch the front access panel to the housing when the front access panel is in the closed position, and structured to open the front access panel correspondingly de-actuating the latching apparatus by translating the plurality of movable latch rods in a second direction opposite the first direction, such that the series of hook-shaped profiles mechanically disengage from the series of stationary pins,
wherein a circuit breaker is housed in the enclosure and the latching apparatus latches the front access panel to the housing when the front access panel is in the closed position and is subjected to internal pressure waves and destructive forces produced under fault conditions, and wherein the handle includes a rack-and-pinion mechanism coupled to the plurality of movable latch rods such that rotations of the handle translate the plurality of movable latch rods in the first and second directions.

5. An arc-resistant electrical switching assembly enclosure, the enclosure comprising:

a housing, comprising:

an outer surface;

a cavity formed by the outer surface, and the cavity comprising a front opening having a perimeter; and a housing perimeter formed by the perimeter of the front opening;

a front access panel having a perimeter, wherein the front access panel is connected to the housing perimeter, and the front access panel is structured to open outwardly to provide access to the cavity of the housing; and an arc-resistant latching apparatus, comprising:

a series of stationary substantially c-shaped channels mounted to the housing, and extending in succession along portions of the housing perimeter, wherein each stationary substantially c-shaped channel has a length, an upper leg, a lower leg, and a vertical wall extending the length of the stationary substantially c-shaped channel, connecting the upper and lower legs;

a series of stationary pins inserted and extending through the upper leg and the lower leg of each of the stationary substantially c-shaped channels;

a plurality of movable latch rods connected to and extending along portions of the perimeter of the front access panel, the plurality of movable latch rods structured to be positioned within the series of stationary substantially c-shaped channels, and each of the plurality of movable latch rods, having formed therein, a series of profiles in succession and structured to correspondingly mechanically engage the stationary pins; and a handle connected to the front access panel and structured to allow a user to place the front access panel in the closed position and correspondingly actuate the latching apparatus by translating the plurality of movable latch rods in a first direction in succession along the perimeter of the front access panel within the series of stationary substantially c-shaped channels, a distance that extends along the length of each of the stationary substantially c-shaped channels in the series, such that the series of profiles mechanically engage the series of stationary pins to latch the front access panel to the housing when the front access panel is in a closed position, and structured to open the front access panel correspondingly de-actuating the latching apparatus by translating the plurality of movable latch rods in a second direction opposite the first direction, such that the series of profiles mechanically disengage from the series of stationary pins, wherein the latching apparatus latches the front access panel to the housing when the front access panel is in the closed position to secure the front access panel to the housing when subjected to internal pressure and force produced under fault conditions.

* * * * *